US011779130B2

(12) United States Patent
Zhong

(10) Patent No.: US 11,779,130 B2
(45) Date of Patent: Oct. 10, 2023

(54) CHILD BASSINET

(71) Applicant: Wonderland Switzerland AG, Steinhausen (CH)

(72) Inventor: Zhiren Zhong, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 129 days.

(21) Appl. No.: 17/386,393

(22) Filed: Jul. 27, 2021

(65) Prior Publication Data

US 2022/0031089 A1 Feb. 3, 2022

(30) Foreign Application Priority Data

Jul. 31, 2020 (CN) ..... 202010765788.0

(51) Int. Cl.
*A47D 9/00* (2006.01)

(52) U.S. Cl.
CPC ..... *A47D 9/005* (2013.01)

(58) Field of Classification Search
CPC ..... A47D 9/00; A47D 9/005; A47D 9/008; A47D 9/012; A47D 9/016; A47D 11/005; A47D 13/00; A47D 13/02; A47D 7/00; A47D 7/002
See application file for complete search history.

(56) References Cited

U.S. PATENT DOCUMENTS 5,193,234 A * 3/1993 Joaquin ..... A47D 7/002 5/99.1
6,588,033 B1 * 7/2003 Welsh, Jr. ..... A47D 7/002 5/98.1
7,464,420 B2 * 12/2008 Chen ..... A47D 9/005 5/98.1
9,138,070 B1 * 9/2015 Shamie ..... A47D 7/002
9,883,750 B2 * 2/2018 Yi ..... A47D 9/00
(Continued)

FOREIGN PATENT DOCUMENTS

CN 209750536 U 12/2019

OTHER PUBLICATIONS

Office Action of the corresponding Taiwanese patent application No. 110127669 (along with an English Search Report) dated Dec. 9, 2022.

*Primary Examiner* — David R Hare
*Assistant Examiner* — George Sun
(74) *Attorney, Agent, or Firm* — NZ CARR LAW OFFICE PLLC

(57) ABSTRACT

A child bassinet includes a standing frame, and a top rail portion and a support frame portion respectively connected with the standing frame. The standing frame includes a first leg having two first side segments, and a second leg having two second side segments. The top rail portion includes a first rail respectively connected pivotally with the two first side segments and a second rail respectively connected pivotally with the two second side segments. The support frame portion includes two first bar segments that are respectively connected pivotally with the two first side segments and are fixedly connected with a first coupling part, and two second bar segments that are respectively connected pivotally with the two second side segments and are fixedly connected with a second coupling part, the first and second coupling parts being pivotally connected with each other for forming a central hinge of the support frame portion.

19 Claims, 23 Drawing Sheets

(56) References Cited

U.S. PATENT DOCUMENTS

| | | | | |
|---|---|---|---|---|
| 10,154,737 | B2 * | 12/2018 | Horst | A47D 5/00 |
| 11,122,913 | B2 * | 9/2021 | Tuckey | A47D 9/005 |
| 11,147,392 | B2 * | 10/2021 | Mountz | A47D 7/002 |
| 11,241,101 | B2 * | 2/2022 | Mountz | F16B 12/56 |
| 2018/0303250 | A1 * | 10/2018 | Mountz | A47D 9/005 |
| 2018/0360230 | A1 * | 12/2018 | Tuckey | A47D 9/005 |
| 2019/0045944 | A1 * | 2/2019 | Yang | A47D 7/002 |

* cited by examiner

21

CHILD BASSINET

CROSS-REFERENCE TO RELATED APPLICATION(S)

This application claims priority to China patent application no. 202010765788.0 filed on Jul. 31, 2020.

BACKGROUND

1. Field of the Invention

The present invention relates to child bassinets.

2. Description of the Related Art

Baby bassinets can provide a comfortable and safe environment for sleeping a young child. The child bassinet can typically provide support for the child at an elevated position so that a caregiver can easily reach the child for dispensing care. Unfortunately, child bassinets currently available on the market may have some disadvantages. For example, some existing child bassinets may be not be convenient to operate for folding and unfolding. Moreover, certain child bassinets may hang an enclosure element in which a child can be received from a top rail structure, which may not be stable in use.

Therefore, there is a need for a child bassinet that is convenient to use, and address at least the foregoing issues.

SUMMARY

The present application describes a child bassinet that is relatively simple in construction, can provide stable support for a child, and can be folded and unfolded in a convenient way.

According to one embodiment, the child bassinet includes a standing frame, and a top rail portion and a support frame portion respectively connected with the standing frame. The standing frame includes a first leg and a second leg, the first leg having two first side segments, the second leg having two second side segments. The top rail portion includes a first rail respectively connected pivotally with the two first side segments and a second rail respectively connected pivotally with the two second side segments. The support frame portion includes two first bar segments that are respectively connected pivotally with the two first side segments and are fixedly connected with a first coupling part, and two second bar segments that are respectively connected pivotally with the two second side segments and are fixedly connected with a second coupling part, the first and second coupling parts being pivotally connected with each other about a pivot axis for forming a central hinge of the support frame portion.

DETAILED DESCRIPTION OF THE EMBODIMENTS

Referring to FIGS. 1-10, a child bassinet 100 includes a frame structure 10, a support pad 21 and an enclosure 40. The frame structure 10 can provide a rigid support to which the enclosure 40 can be attached to delimit at least partially an interior space 40A suitable to receive a child. The support pad 21 can be disposed at a bottom of the interior space 40A of the enclosure 40 to provide support for the child.

Figure 1:
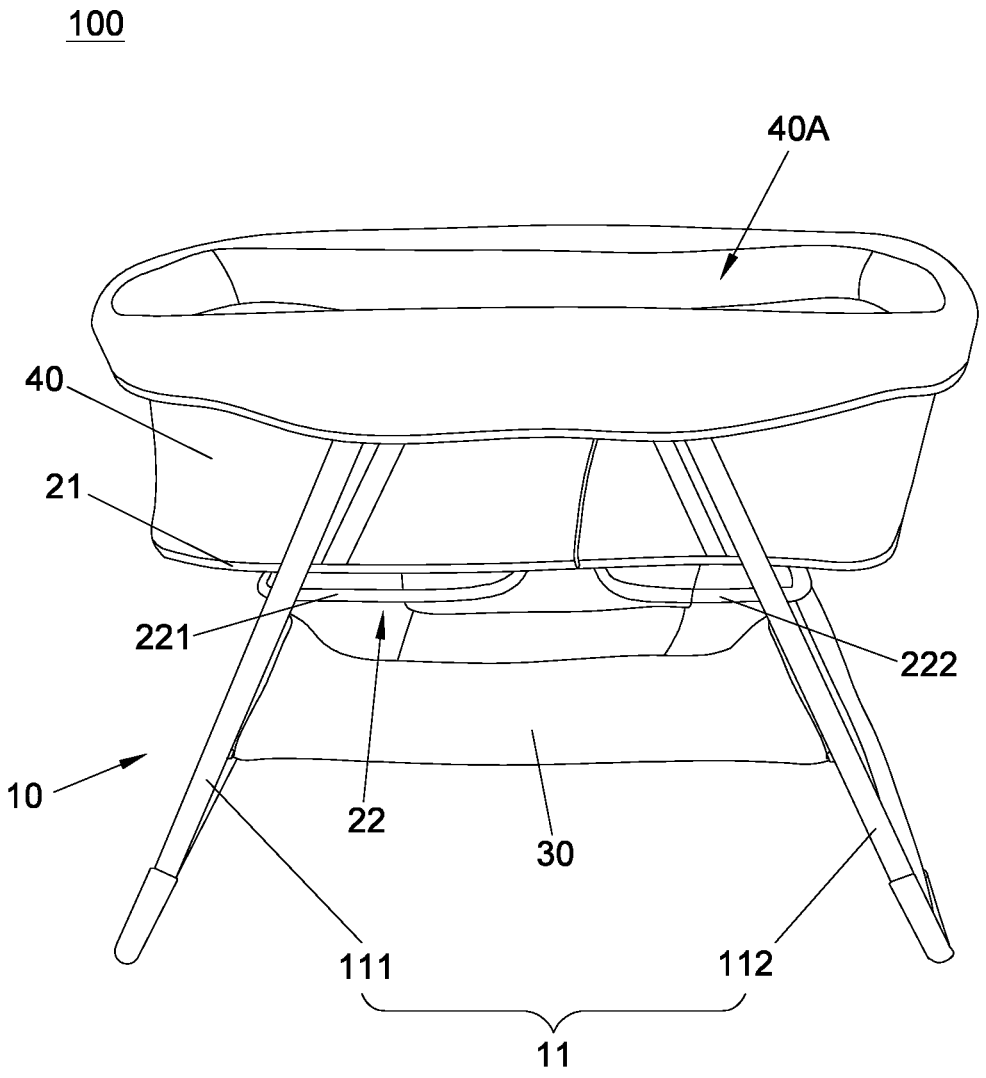
FIG. 1 is a perspective view illustrating an embodiment of a child bassinet.
Figure 2:
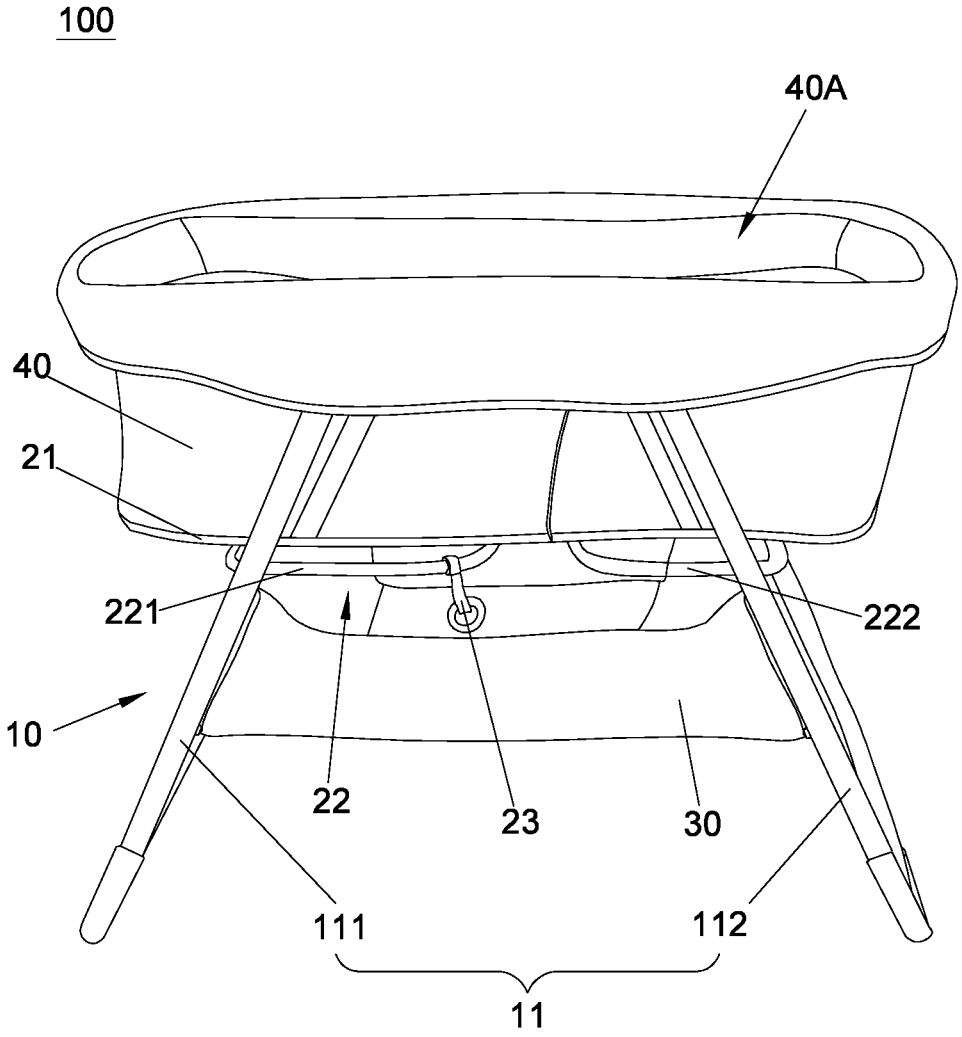
FIG. 2 is a perspective view illustrating the child bassinet provided with an operating part for facilitating folding operation.
Figure 3:
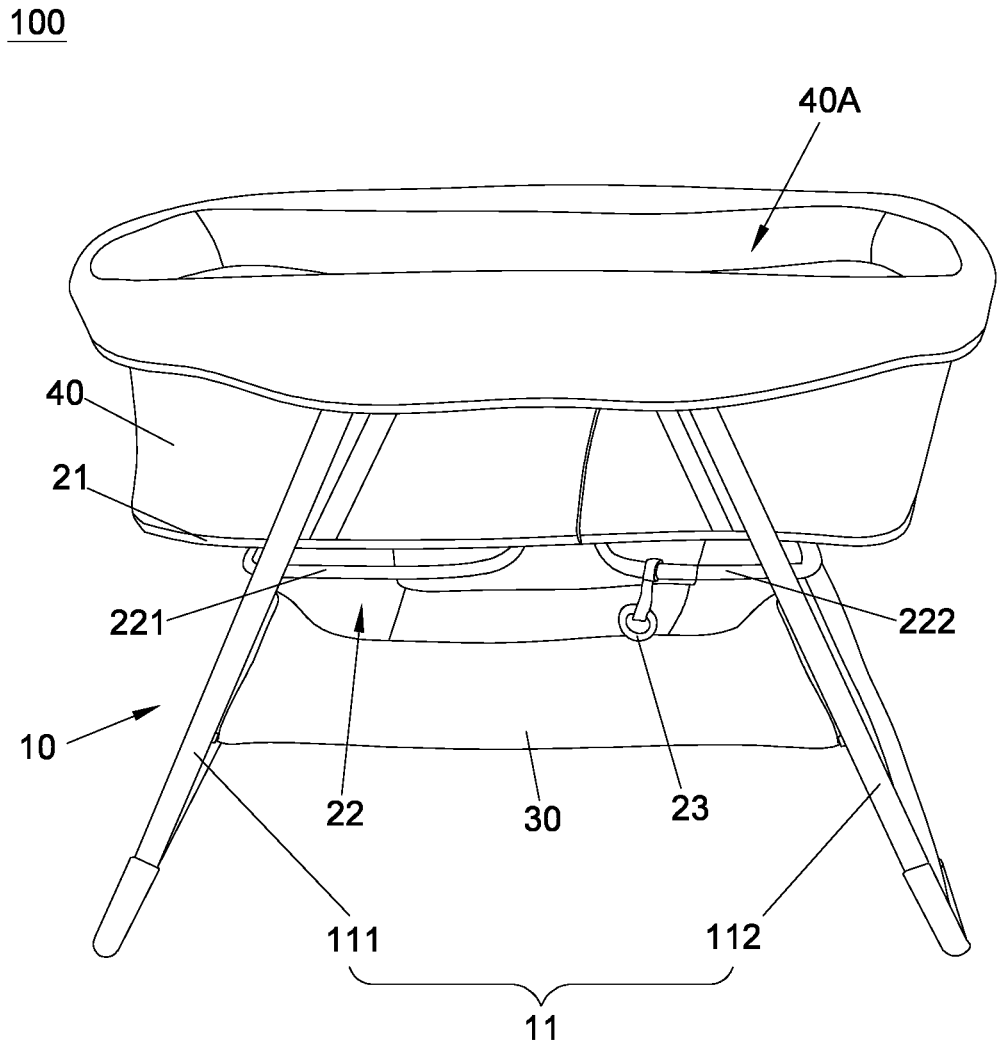
FIG. 3 is a perspective view illustrating the child bassinet provided with another arrangement of the operating part.
Figure 4:
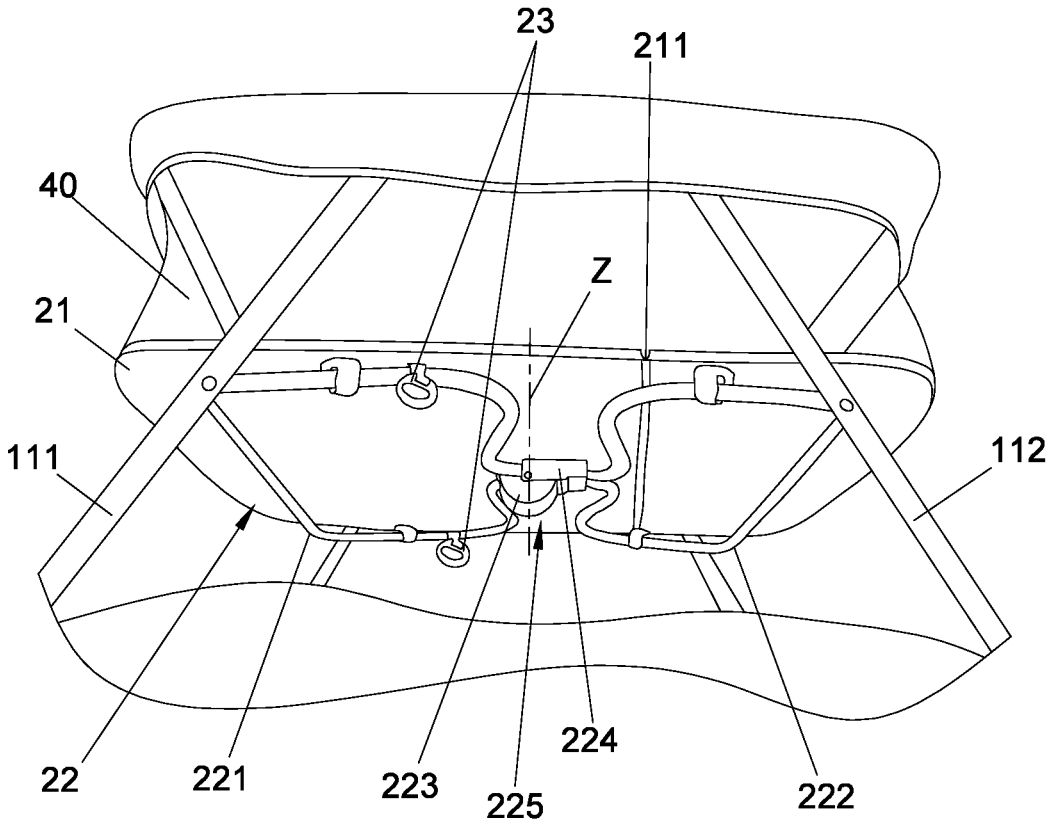
FIG. 4 is a perspective view illustrating some construction details of a support frame portion provided in the child bassinet.
Figure 5:
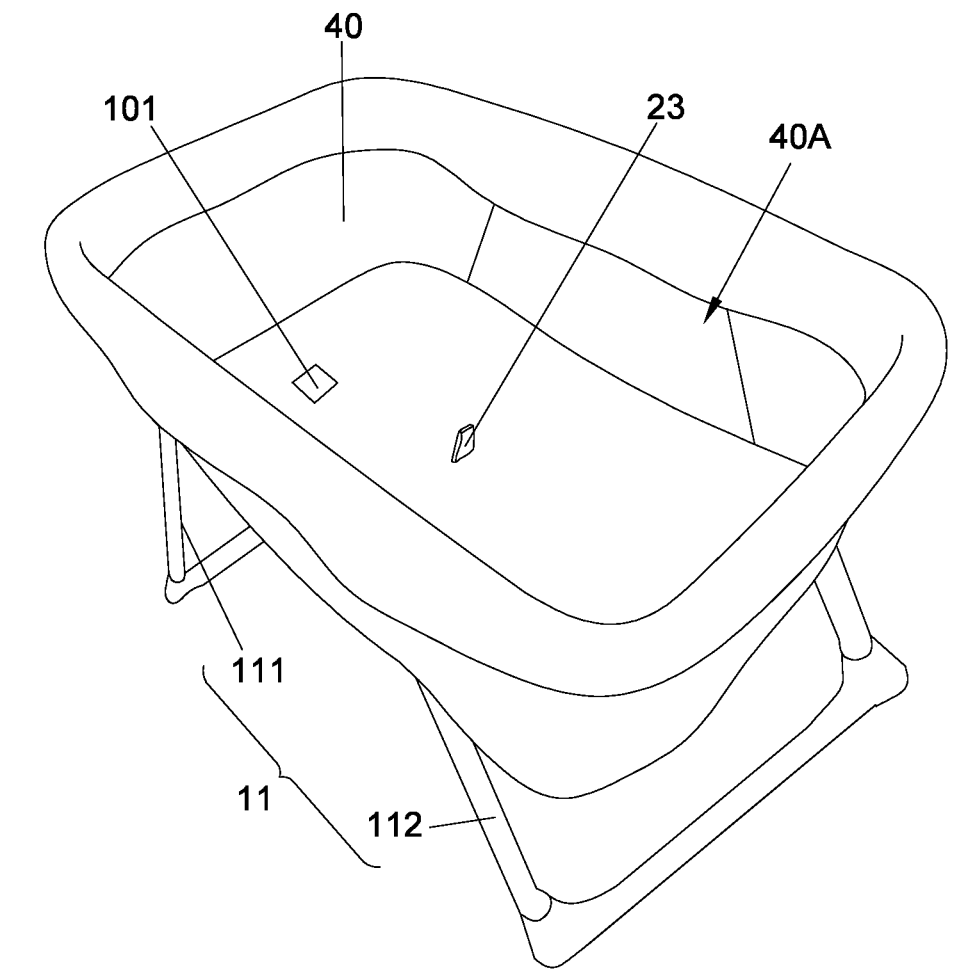
FIG. 5 is a perspective view illustrating another arrangement of the operating part that is connected with a bottom panel of an enclosure provided in the child bassinet.
Figure 9:
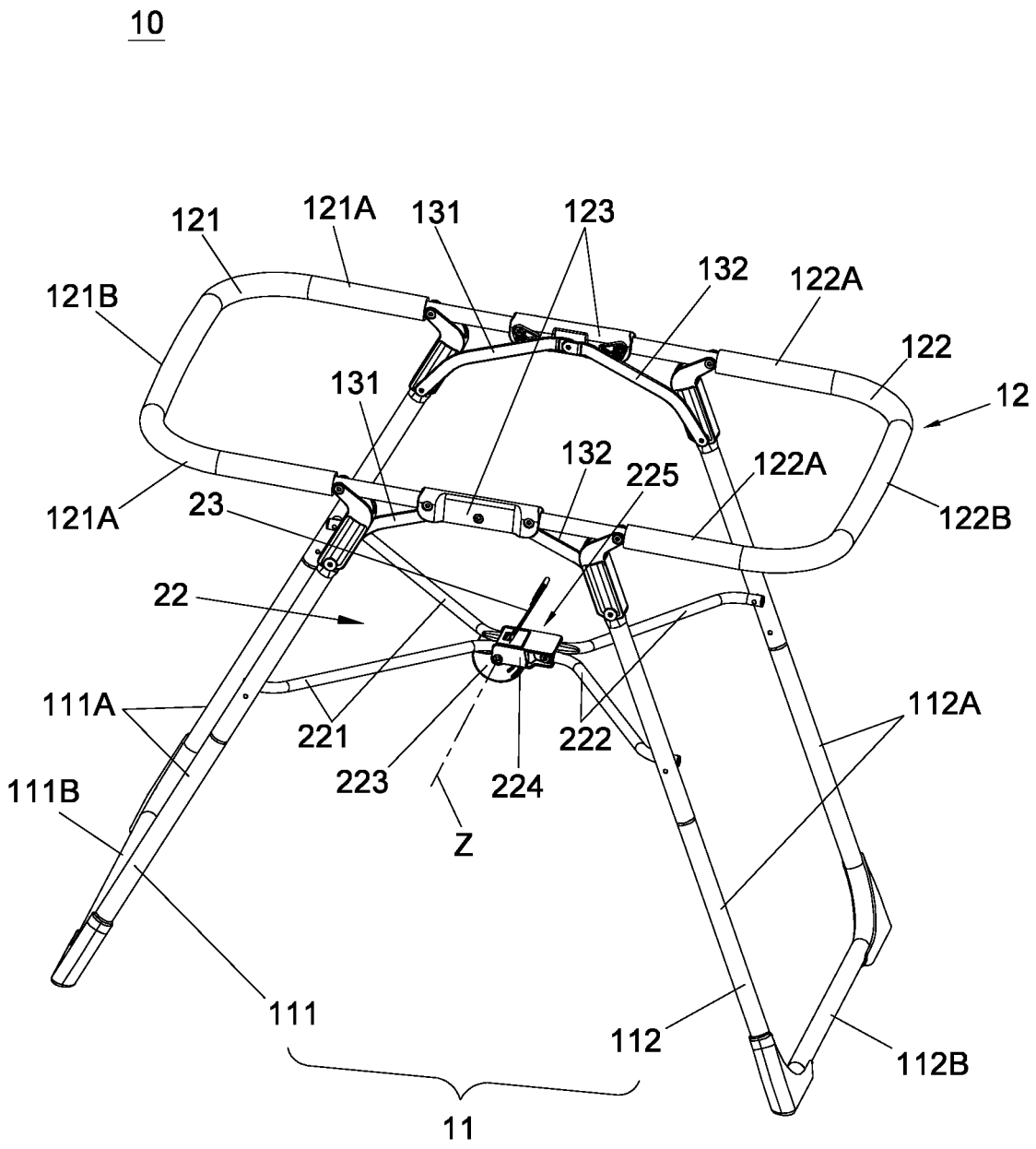
FIG. 9 is a perspective view illustrating a frame structure of the child bassinet.
Figure 10:
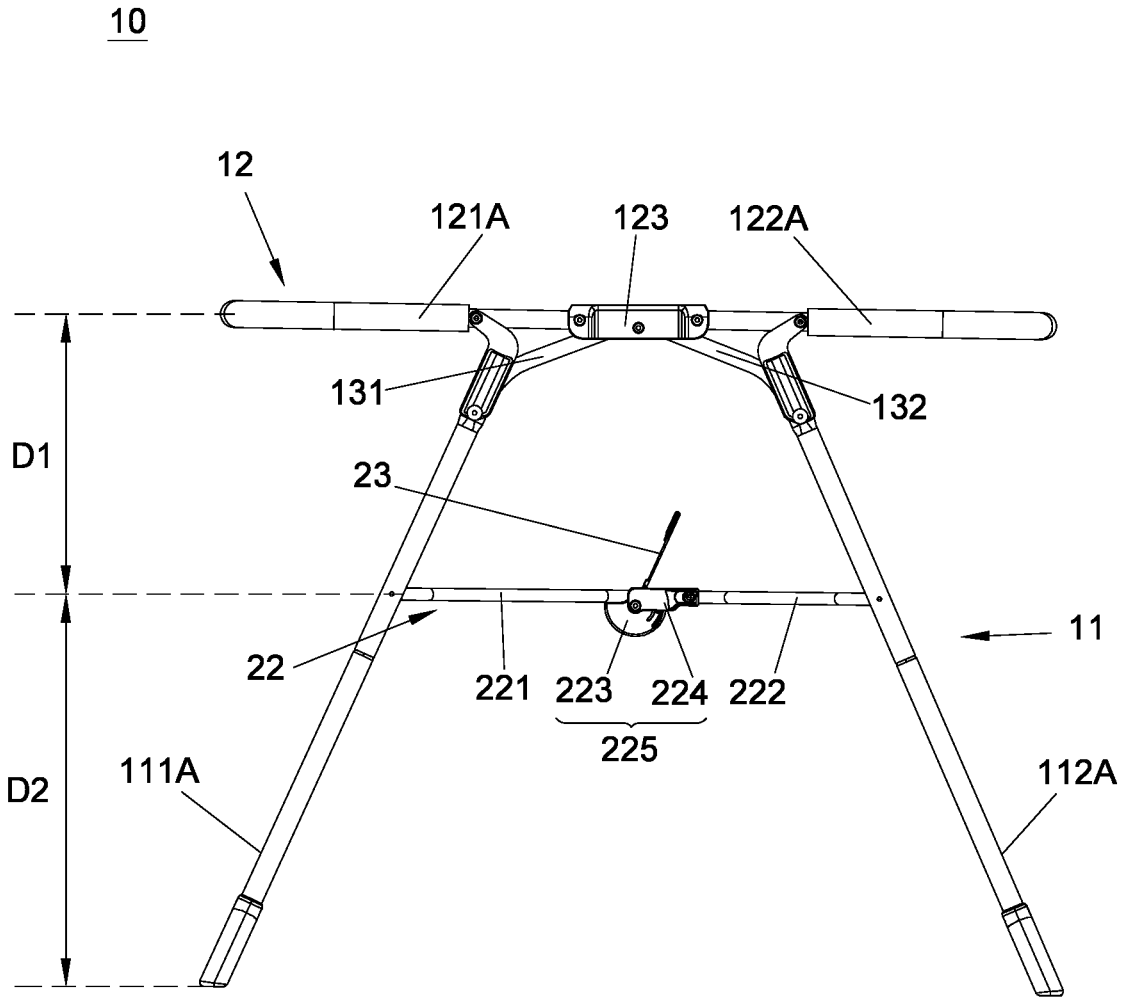
FIG. 10 is a side view illustrating the frame structure of the child bassinet.
Figure 11:
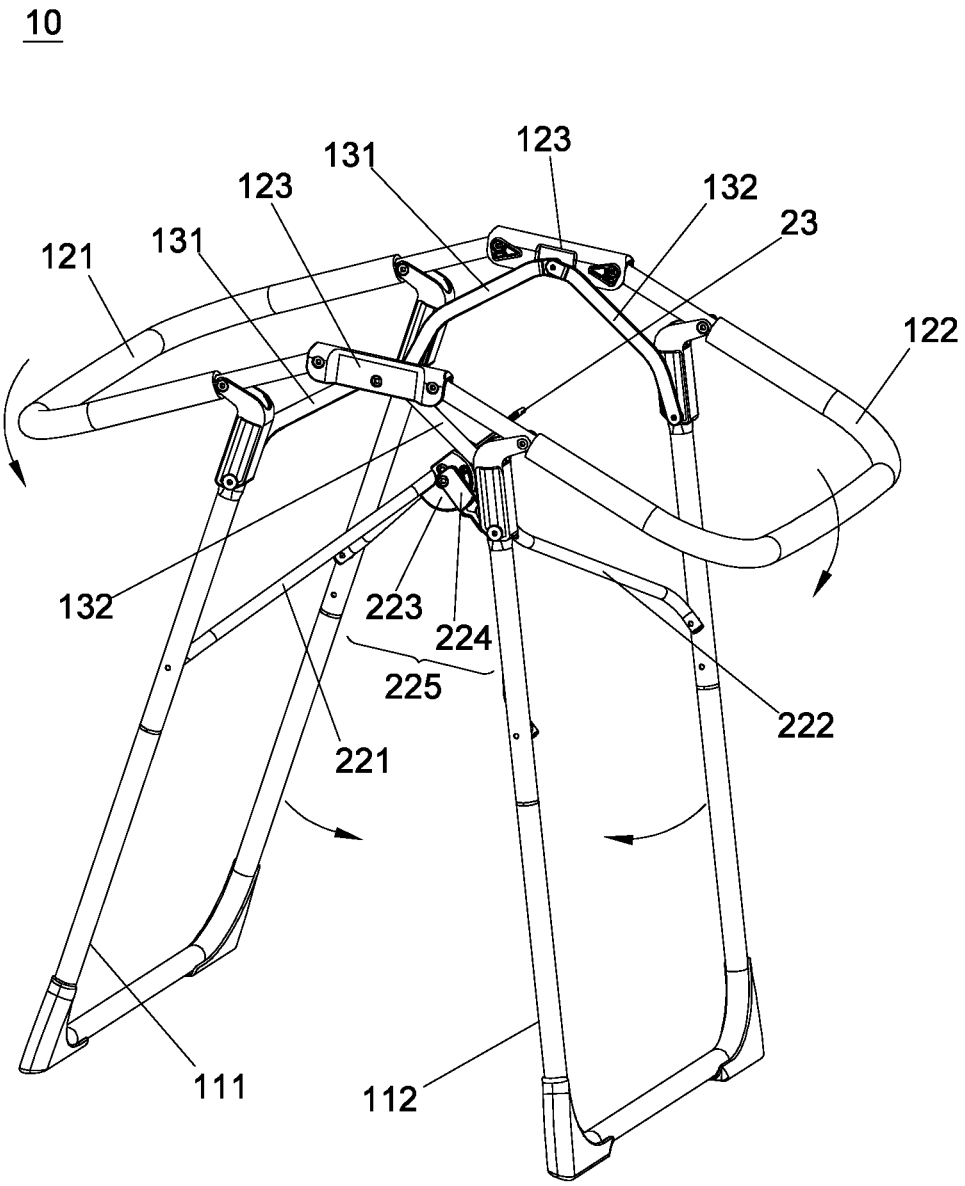
FIG. 11 is a perspective view illustrating exemplary folding of the frame structure of the child bassinet.
Figure 12:
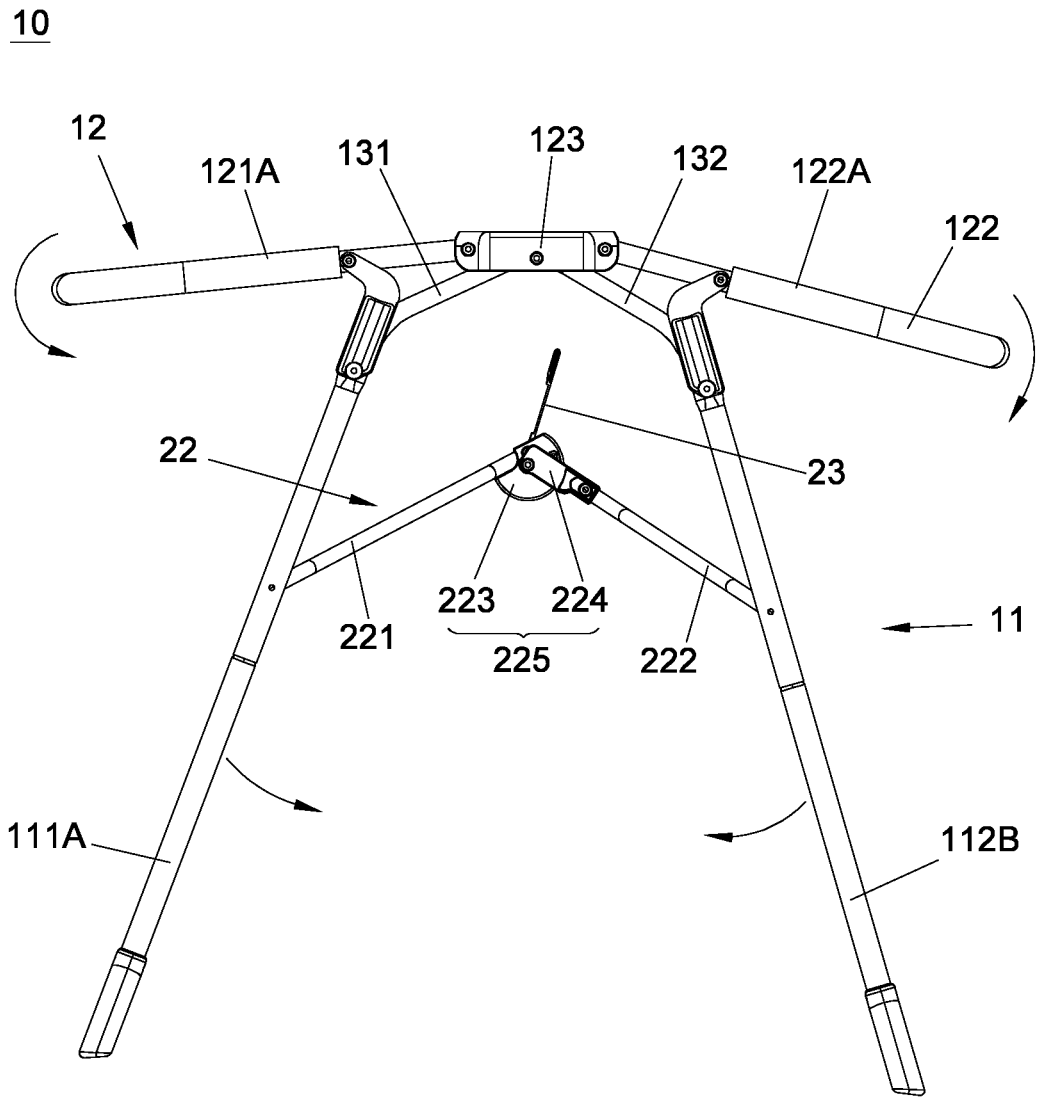
FIG. 12 is a side view illustrating exemplary folding of the frame structure of the child bassinet.

Referring to FIGS. 1, 9 and 10, the frame structure 10 has a foldable construction that can be unfolded for use and folded for storage or transport. The frame structure 10 can include a standing frame 11, and a top rail portion 12 and a support frame portion 22 respectively connected with the standing frame 11. The standing frame 11 is adapted to stand on a floor surface. According to an example of construction, the standing frame 11 includes two legs 111 and 112 having a similar structure. For example, the leg 111 can have two side segments 111A and a transversal segment 111B fixedly connected with the two side segments 111A, and the leg 112 can likewise have two side segments 112A and a transversal segment 112B fixedly connected with the two side segments 112A.

The top rail portion 12 can include two rails 121 and 122 having a similar structure that are connected with each other via two articulations 123. For example, the rail 121 can have two side segments 121A and an end segment 121B fixedly connected with the two side segments 121A, and the rail 122 can likewise have two side segments 122A and an end segment 122B fixedly connected with the two side segments 122A. Each of the two articulations 123 can include, without limitation, a housing or a bracket, and can be respectively connected pivotally with one side segment 121A of the rail 121 and one side segment 122A of the rail 122. For example, the two side segments 121A of the rail 121 can be respectively connected pivotally with the two articulations 123 about a first pivot axis, and the two side segments 122A of the rail 122 can be respectively connected pivotally with the two articulations 123 about a second pivot axis spaced apart from the first pivot axis, whereby the rails 121 and 122 are rotatable relative to each other and the two articulations 123 during folding and unfolding of the child bassinet 100.

The top rail portion 12 is pivotally connected with the legs 111 and 112 of the standing frame 11 at top ends of the side segments 111A and 112A. For example, the two side segments 121A of the rail 121 can be respectively connected pivotally with the two side segments 111A of the leg 111 at the top ends thereof, and the two side segments 122A of the rail 122 can be respectively connected pivotally with the two side segments 112A of the leg 112 at the top ends thereof. Moreover, the frame structure 10 further includes a linkage assembly that movably couples the top rail portion 12 to the standing frame 11. According to an example of construction, the linkage assembly includes two linking parts 131 that respectively couple the two side segments 111A of the leg 111 to the two articulations 123, and two linking parts 132 that respectively couple the two side segments 112A of the leg 112 to the two articulations 123. The linking parts 131 and 132 may include, without limitation, rods or bars. Each linking part 131 can have two opposite ends respectively connected pivotally with one side segment 111A and one articulation 123 corresponding thereto, and each linking part 132 can have two opposite ends respectively connected pivotally with one side segment 112A and one articulation 123 corresponding thereto. According to an example of construction, each of the linking parts 131 and 132 is a single bar having a bent shape.

With the aforementioned construction, the standing frame 11 and the top rail portion 12 can move concurrently during unfolding and folding of the child bassinet 100. When the child bassinet 100 is in an unfolded state, the top rail portion 12 forms a closed shape generally extending horizontally, and the legs 111 and 112 extend downward at an angle from the top rail portion 12. When the child bassinet 100 is in a folded state, the legs 111 and 112 extend substantially parallel to each other, and the top rail portion 12 is folded downward so that the rails 121 and 122 are substantially parallel to each other and extend substantially parallel to the legs 111 and 112.

The support frame portion 22 is respectively connected pivotally with the legs 111 and 112 of the standing frame 11 between the top ends and the bottom ends thereof, and has a foldable structure. More specifically, the support frame portion 22 can include a plurality of bar segments that are respectively connected pivotally with the side segments 111A and 112A of the legs 111 and 112 and are connected with a central hinge. For example, the support frame portion 22 can include two bar segments 221 that are respectively connected pivotally with the two side segments 111A of the leg 111 and are fixedly connected with a coupling part 223, and two bar segments 222 that are respectively connected pivotally with the two side segments 112A of the leg 112 and are fixedly connected with a coupling part 224. The two coupling parts 223 and 224 are pivotally connected with each other about a pivot axis Z to form a central hinge 225 of the support frame portion 22. The support frame portion 22 can thereby fold and unfold about the central hinge 225, wherein during folding and unfolding operation, the bar segments 221 and the coupling part 223 are rotatable in unison about the pivot axis Z of the central hinge 225, and the bar segments 222 and the coupling part 224 are rotatable in unison about the pivot axis Z of the central hinge 225.

According to an example of construction better illustrated in FIGS. 15-20, the coupling part 224 can include a cavity 2242 formed between two sidewalls 2241 of the coupling part 224, and the coupling part 223 can be placed in the cavity 2242 and pivotally connected with the two sidewalls 2241 about the pivot axis Z. The coupling part 224 including the sidewalls 2241 may be formed integrally as a single part. The coupling part 223 may be exemplarily formed as a shell that is pivotally disposed in the cavity 2242 of the coupling part 224.

According to an example of construction, a portion of the coupling part 223 disposed in the cavity 2242 of the coupling part 224 can include a comb-like structure having a plurality of fins 2234 distributed parallel to one another along the pivot axis Z, the fins 2234 being spaced apart from one another via a plurality of inter-fin gaps 2235. The aforementioned comb-like structure reduces the weight of the coupling part 223, which may facilitate operation of the central hinge 225.

According to an example of construction, the coupling parts 223 and 224 can respectively have stop structures 2236 and 2243 adapted to engage with each other for stopping the support frame portion 222 in the unfolded state, thereby preventing excessive rotation about the pivot axis Z in the unfolding direction. According to an example of construction, the stop structure 2243 can be fixedly connected with the coupling part 224, and can have a comb-like structure of protruding teeth 22431 that are disposed in the cavity 2242 and are spaced apart from one another along the pivot axis Z. According to an example of construction, the stop structure 2236 can be fixedly connected with the coupling part 223, and can include one or more flange disposed adjacent to an end of the fins 2234. As the coupling parts 223 and 224 rotate relative to each other about the pivot axis Z during folding or unfolding of the support frame portion 22, the protruding teeth 22431 can respectively travel through the inter-fin gaps 2235. When the support frame portion 22 reaches the unfolded state, the protruding teeth 22431 can contact against the flange(s) of the stop structure 2236 to stop the support frame portion 22, which can prevent further rotation about the pivot axis Z in the unfolding direction. According to an example of construction, the central hinge 225 is configured to have a range of rotation of about 180 degrees to allow compact folding.

It will be appreciated that the coupling parts 223 and 224 described herein may be interchanged by fixedly connecting the coupling part 223 with the bar segments 222 and fixedly connecting the coupling part 224 with the bar segments 221.

With the aforementioned construction, the bar segments 221 and 222 can move along with the legs 111 and 112 and rotate relative to each other about the pivot axis Z for unfolding and folding the support frame portion 22. When the child bassinet 100 is in the unfolded state, the support frame portion 22 is unfolded so that the bar segments 221 and the bar segments 222 generally extend horizontally in opposite directions from the central hinge 225, the support frame portion 22 being located at an elevated position above a floor surface and below the top rail portion 12. As illustrated in FIG. 10, a vertical distance D1 between the top rail portion 12 and the support frame portion 22 can be smaller than a vertical distance D2 between a lowermost end of the standing frame 11 and the support frame portion 22 when the frame structure 10 stands in the unfolded state for use. This may facilitate access to a child received in the child bassinet 100. When the child bassinet 100 is in the folded state, the support frame portion 22 is folded about the central hinge 225 so that the bar segments 221 extend substantially parallel and close to the bar segments 222.

Referring to FIGS. 1 and 9-18, when the child bassinet 100 is in the unfolded state, the central hinge 225 can include a locking mechanism operable to prevent folding of the support frame portion 22 so that the child bassinet 100 can be locked in the unfolded state. For example, the locking mechanism can include a latch 2231 carried with the coupling part 223 that is movable to engage with and disengage from the coupling part 224. For example, when the child bassinet 100 is in the unfolded state, the latch 2231 can be engaged with a lower edge 224A of the coupling part 224 to prevent the bar segments 221 and the coupling part 223 from rotating about the pivot axis Z relative to the bar segments 222 and the coupling part 224 in the folding direction, which can lock the support frame portion 22 and the child bassinet 100 in the unfolded state. When the latch 2231 is disengaged from the lower edge 224A of the coupling part 224, the bar segments 221 and the coupling part 223 can rotate about the pivot axis Z relative to the bar segments 222 and the coupling part 224 in the folding direction for folding of the child bassinet 100.

According to another example of construction, the latch 2231 carried with the coupling part 223 can be configured to frictionally contact with the coupling part 224 (e.g., with the inner surface of one sidewall 2241 of the coupling part 2241) to resist against a rotation in the folding direction. When the child bassinet 100 is in the unfolded state, the resistance provided by the frictional contact between the latch 2231 and the coupling part 224 can prevent accidental folding of the child bassinet 100.

The latch 2231 can be biased for engagement with the coupling part 224 for holding the support frame portion 22 and the child bassinet 100 in the unfolded state. According to an example of construction, the latch 2231 can be formed as a resilient arm 2232 that is connected with the coupling part 223 and has a free end provided with a protrusion adapted to engage with and disengage from the coupling part 224. For example, the resilient arm 2232 may be disposed spaced apart from the pivot axis Z of the central hinge 225 in a slot 2233 provided on a side surface of the coupling part 223. Moreover, the resilient arm 2232 may exemplarily have a curved shape extending along an arc approximately centered on the pivot axis Z, which may facilitate engagement and disengagement of the latch 2231 with respect to the coupling part 224. According to an example of construction, the latch 2231 (including the resilient arm 2232) may be formed integrally with the coupling part 223. The resilient arm 2232 can elastically deflect outward from a side of the coupling part 223 so that the protrusion at the free end of the resilient arm 2232 can engage with the lower edge 224A of the coupling part 224 in the unfolded state. The latch 2231 can be disengaged from the lower edge 224A of the coupling part 224 by urging the resilient arm 2232 to deflect inward so that the protrusion at the free end thereof disengages from the lower edge 224A of the coupling part 224.

It will be appreciated that another possible construction of the locking mechanism may have the latch 2231 carried with the coupling part 224 rather than the coupling part 223 as described previously, the latch 2231 thereby arranged being movable to engage with and disengage from the coupling part 223.

Referring to FIGS. 1 and 9, the enclosure 40 is stretched between the top rail portion 12 and the support frame portion 22, and delimits at least partially the interior space 40A of the child bassinet 100 where a child can be received. The enclosure 40 can be made of soft materials, which can include, without limitation, fabrics, mesh materials, and the like. The enclosure 40 can have an upper end attached to the top rail portion 12, and a lower end attached to the support frame portion 22.

Referring to FIGS. 1, 5, 9, 21 and 23, the support pad 21 can be detachably installed on the support frame portion 22. The support pad 21 and the support frame portion 22 can thereby form a bottom structure adapted to provide resting support for a child. According to an example of construction, the support pad 21 can be disposed in contact with the support frame portion 22. According to another example of construction, the enclosure 40 can have a bottom panel that is stretched across a bottom of the interior space 40A to upwardly cover the support frame portion 22, and the support pad 21 can be disposed in contact with the bottom panel of the enclosure 40. An attaching structure may be provided to fasten the support pad 21 to the enclosure 40 and/or the support frame portion 22. For example, the enclosure 40 can have a hook-and-loop fastener 101 (e.g., provided on the bottom panel thereof) that can attach to a hook-and-loop fastener 101 provided on a lower surface of the support pad 21. According to an example of construction, the support pad 21 may also have a fastening part (e.g., an anchoring strap) that can pass through the enclosure 40 and attach to any of the bar segments 221 and/or 222. The aforementioned examples of attachments allow to attach and detach the support pad 21 as desired, which may facilitate its use, transport and cleaning. Once the support pad 21 is installed on the support frame portion 22, the support pad 21 can fold and unfold along with the frame structure 10. The support pad 21 can generally extend horizontally in the unfolded state, and fold downward similar to the support frame portion 22 in the folded state.

Referring to FIGS. 1, 6, 8 and 21-23, the support pad 21 can include a hinge 211 for facilitating folding and unfolding of the support pad 21. For example, the support pad 21 can include at least two pad portions 212 and 213 that are coupled to each other via the hinge 211, whereby the support pad 21 can unfold and fold about the hinge 211. According to an example of construction, the hinge 211 can be formed by a flexible material (e.g., a fabric) that defines a folding line between the two pad portions 212 and 213 along which the support pad 21 can fold and unfold. According to another example of construction, the hinge 211 may be a crease line formed in the support pad 21. When the support pad 21 is installed on the support frame portion 22, the pivot axis of the hinge 211 can be substantially parallel to the pivot axis Z of the central hinge 225.

Referring to FIGS. 1-7, the child bassinet 100 can further include a storage compartment 30 disposed below the support frame portion 22 for receiving various objects. According to an example of construction, the storage compartment 30 may be a basket made of a flexible material, which can have a lower end fastened to the side segments 111A and 112A of the legs 111 and 112 and an upper end detachably fastened to the bar segments 221 and 222 of the support frame portion 22. For example, the upper end of the storage compartment 30 can be hung on or engaged with the bar segments 221 and 222 of the support frame portion 22 for facilitating disassembly and installation of the storage compartment 30. Once the storage compartment 30 is installed, the storage compartment 30 can be folded and unfolded along with the frame structure 10.

Referring to FIGS. 1-5 and 8-20, an operating part 23 may be disposed adjacent to the central hinge 225 of the support frame portion 22 for facilitating manual folding of the child bassinet 100. More specifically, the operating part 23 is operable to raise the central hinge 225 for folding the child bassinet 100. According to an example of construction shown in FIGS. 9-20, the operating part 23 may be connected with the central hinge 225, such as the coupling part 223 of the central hinge 225. According to another example of construction shown in FIGS. 2-4, the operating part 23 may be connected with any of the bar segments 221 and 222 adjacent to the central hinge 225. According to another variant example of construction shown in FIG. 5, the operating part 23 may be connected with a bottom panel of the enclosure 40 adjacent to the central hinge 225, the bottom panel of the enclosure 40 being attached to the support frame portion 22. The operating part 23 may have any suitable structures that can be manually grasped by a caregiver for operation, which may include, without limitation, flexible belts, rigid handles, loop or ring structures, and the like. For folding the child bassinet 100, a caregiver can grasp and pull the operating part 23 upward, which raises the central hinge 225 and causes folding of the support frame portion 22, which in turn drives the legs 111 and 112 and the top rail portion 12 to fold.

Referring to FIGS. 6, 8, 9 and 22, the support pad 21 may have a tunnel 214 for passage of the operating part 23. According to an example of construction, the tunnel 214 is connected with a bottom surface of the support pad 21 and has an opening 2141 adjacent to the hinge 211. For example, the tunnel 214 may extend through a thickness of the pad portion 212, and the opening 2141 of the tunnel 214 can be formed on a side edge of the pad portion 212 that is adjacent to the hinge 211. The operating part 23 can be received through the tunnel 2141 and can be accessible for operation through the opening 2141. The hinge 211 may be disposed at an off-center location on the support pad 21 so that the hinge 211 can be horizontally distant from the pivot axis Z of the central hinge 225 when the support pad 21 is installed on the support frame portion 22. In this manner, the operating part 23 may be concealed in the tunnel 2141 when the child bassinet 100 is unfolded for use, and a caregiver can grasp the operating part 23 through the opening 2141 for folding operation. According to an example of construction, the opening 2141 may have a size suitable to receive the passage of a caregiver's hand for facilitating grasping of the operating part 23.

Figure 6:
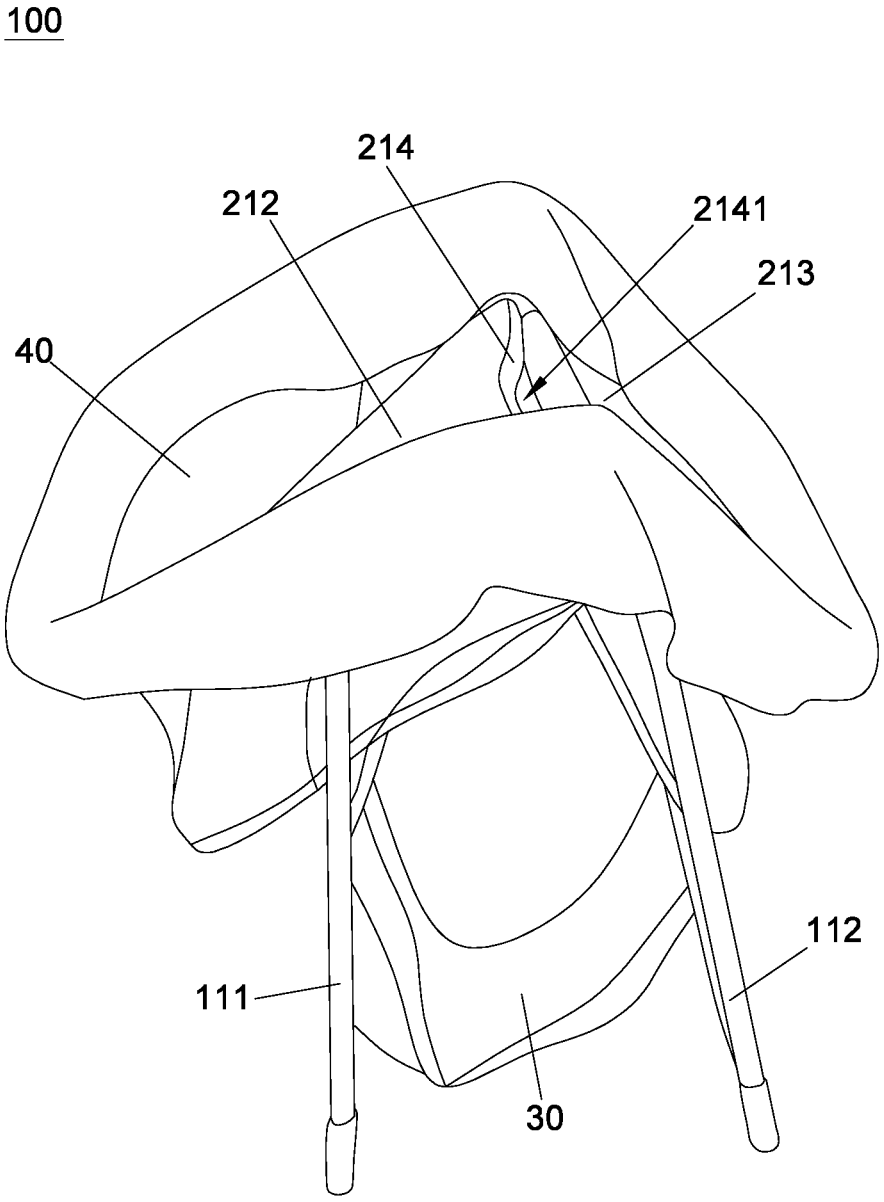
FIG. 6 is schematic view illustrating exemplary folding of the child bassinet.
Figure 7:
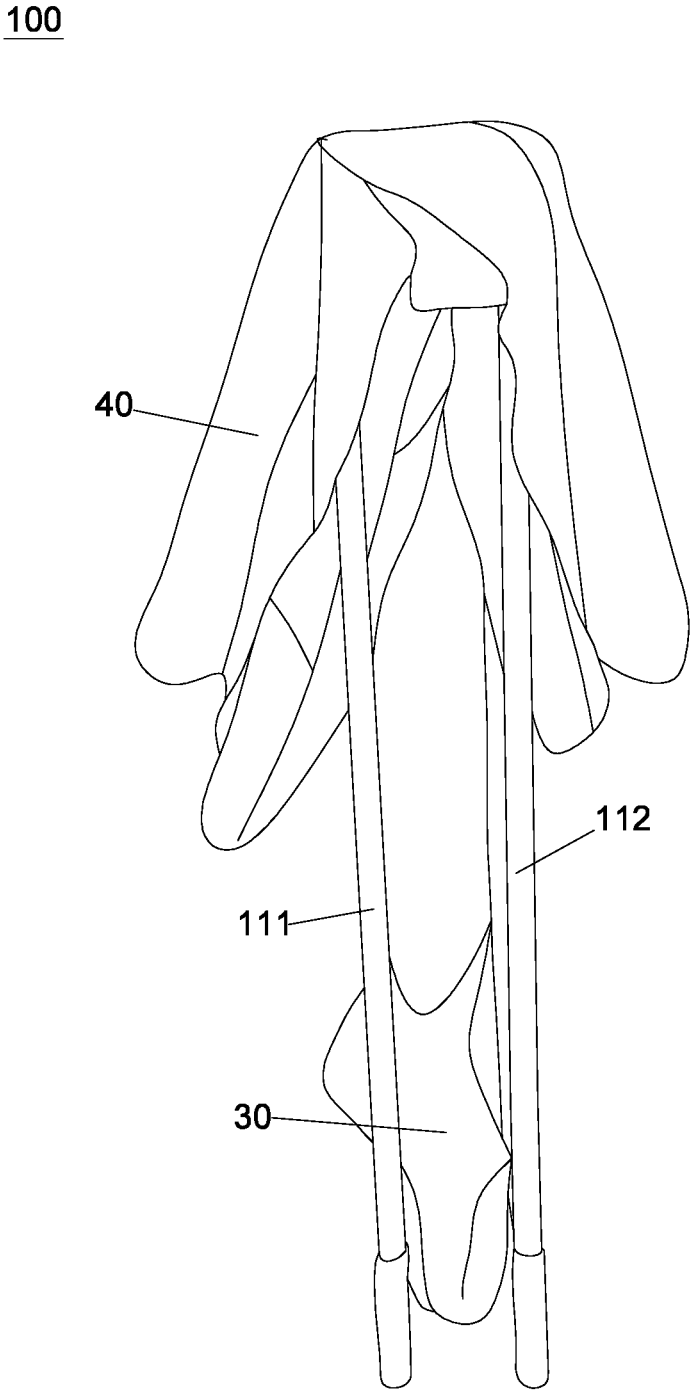
FIG. 7 is a schematic view illustrating the child bassinet fully folded.
Figure 8:
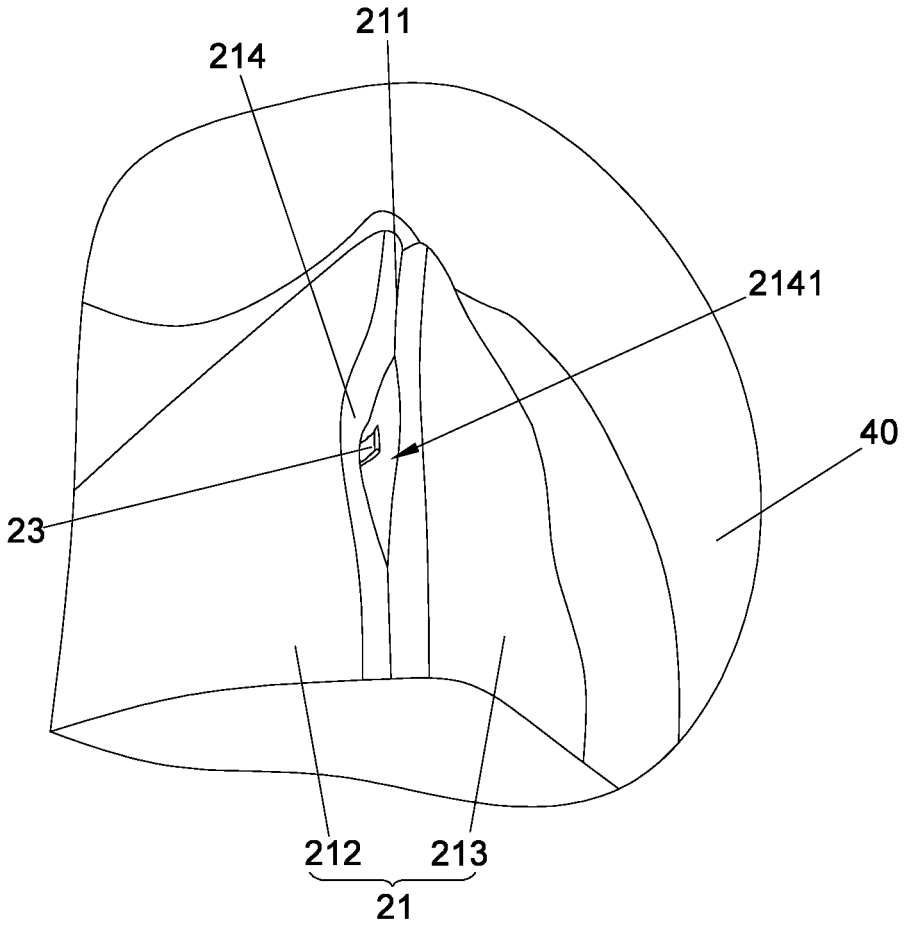
FIG. 8 is an enlarged view illustrating a tunnel provided in a support pad of the child bassinet for the passage of an operating part that is used for folding the child bassinet.
Figure 13:
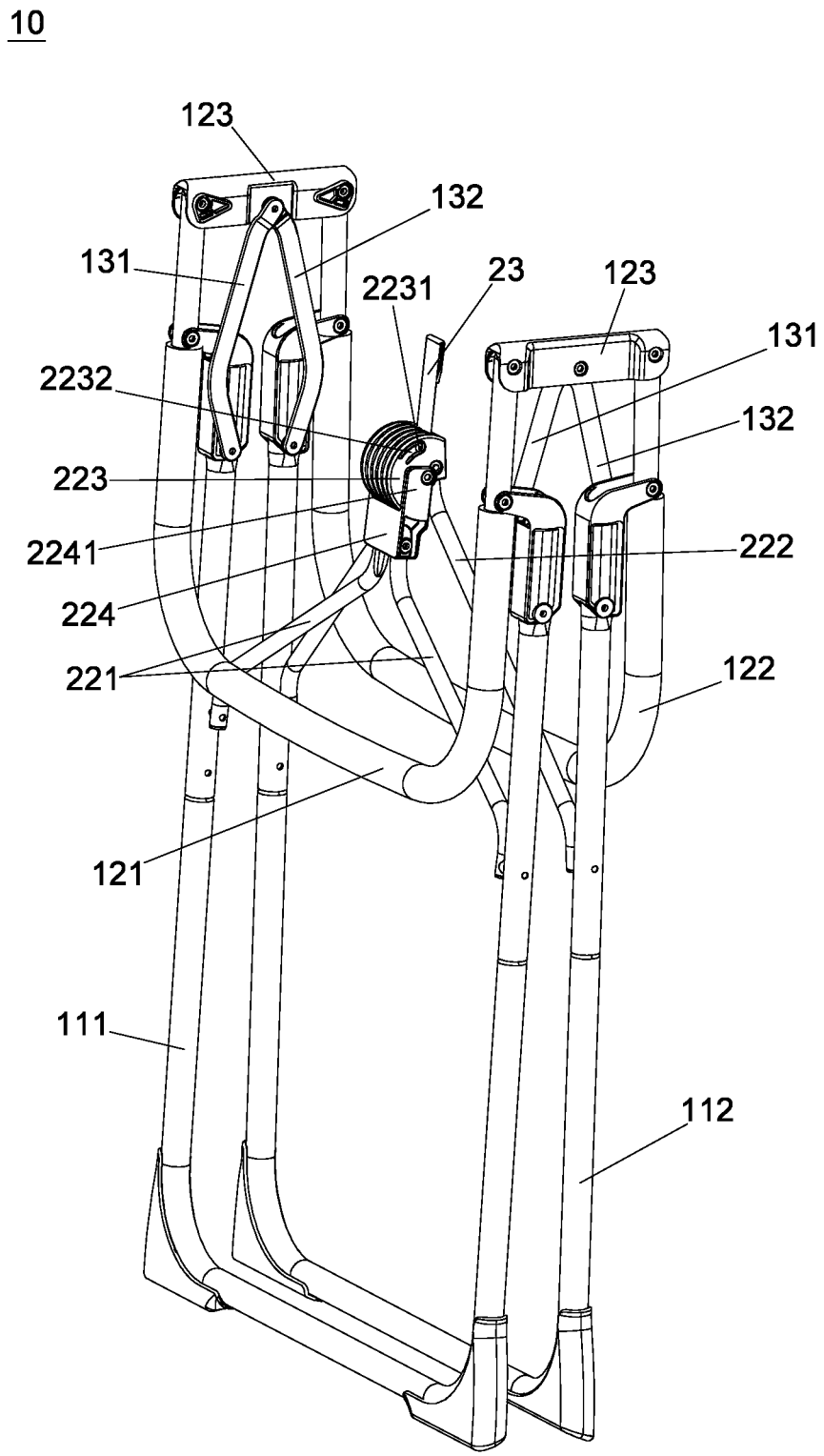
FIG. 13 is a perspective view illustrating the frame structure of the child bassinet in a fully folded state.
Figure 14:
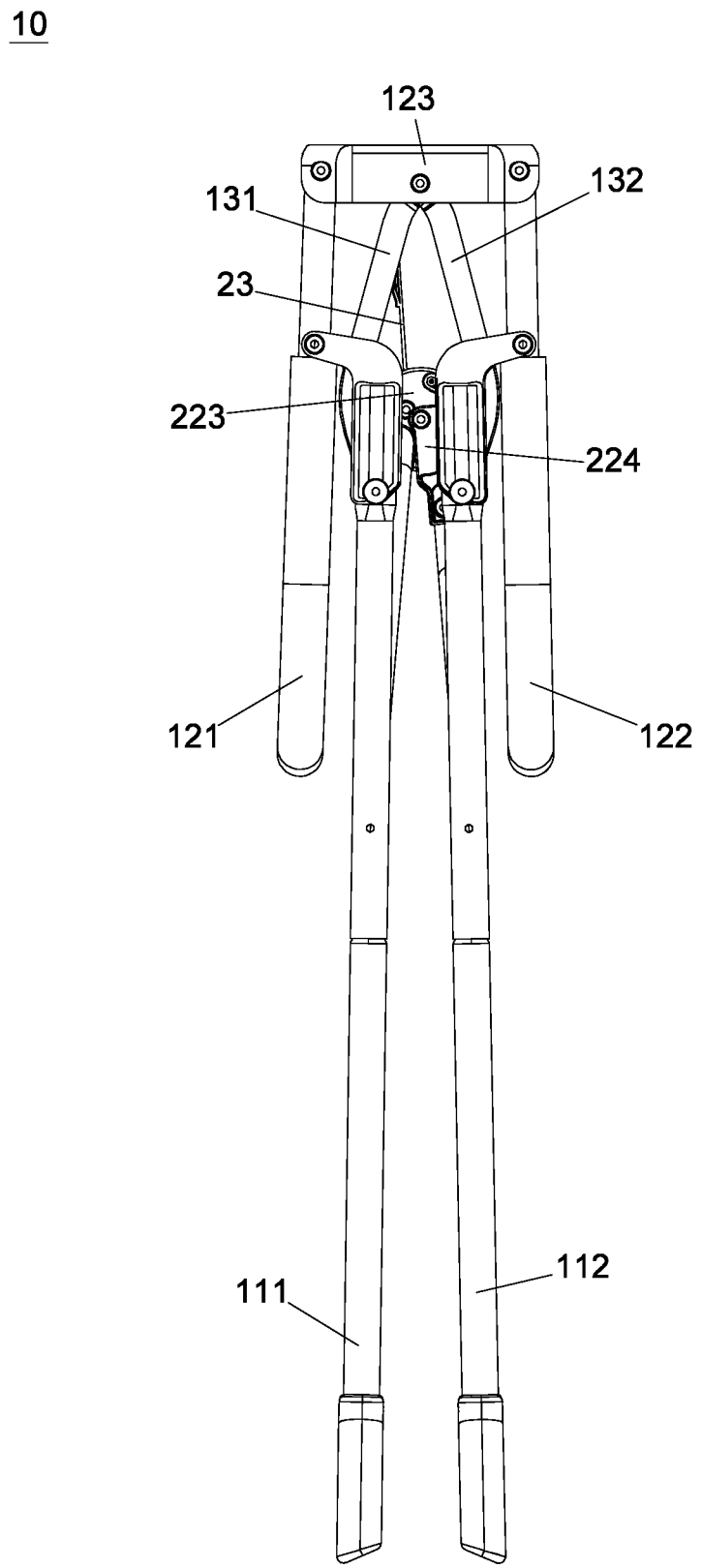
FIG. 14 is a side view illustrating the frame structure of the child bassinet in the fully folded state.
Figure 15:
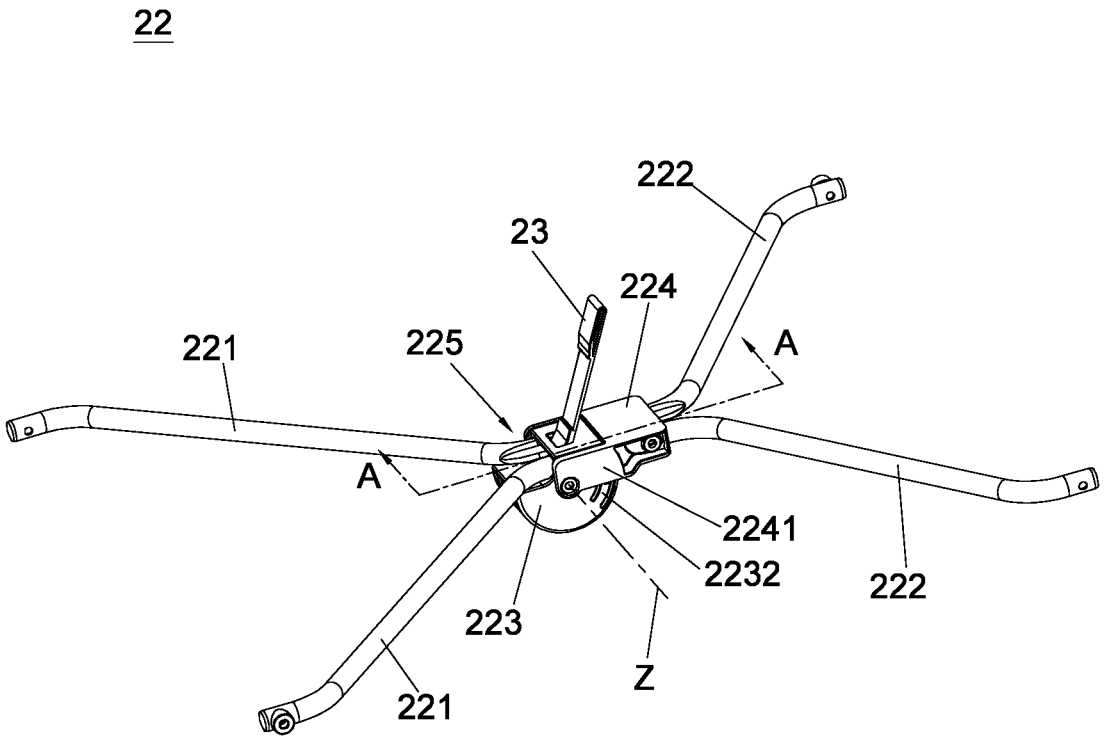
FIGS. 15 and 16 are perspective views illustrating a support frame portion of the frame structure shown in FIG. 9.
Figure 16:
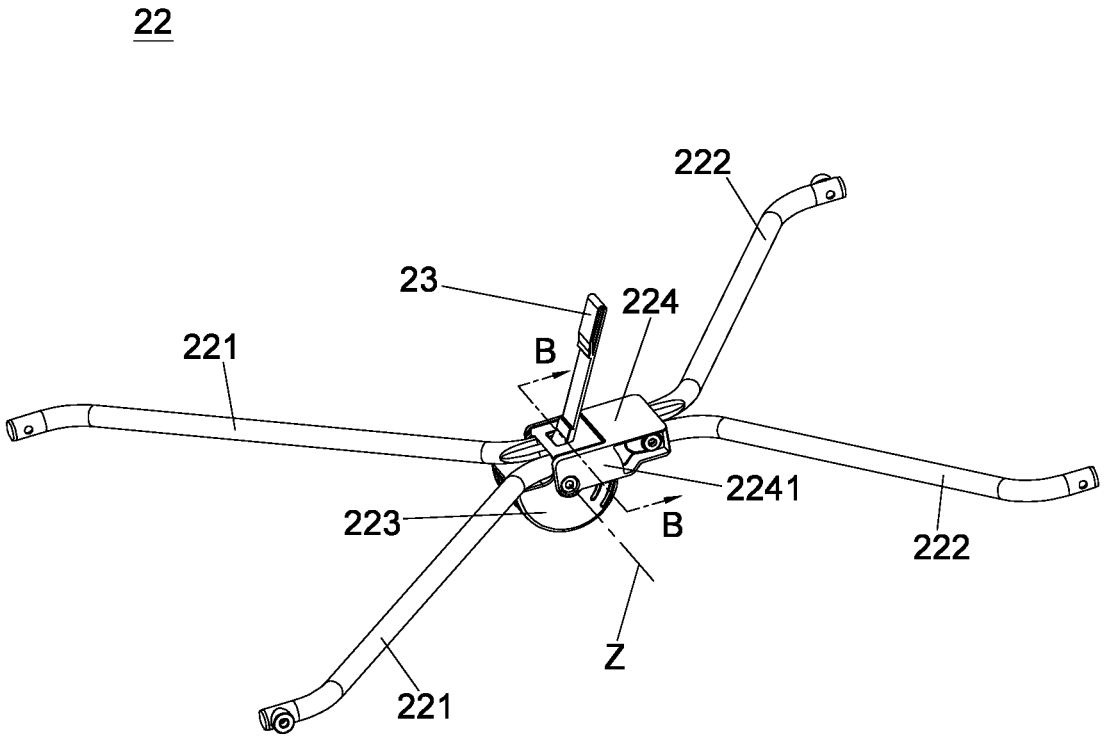
Figure 17:
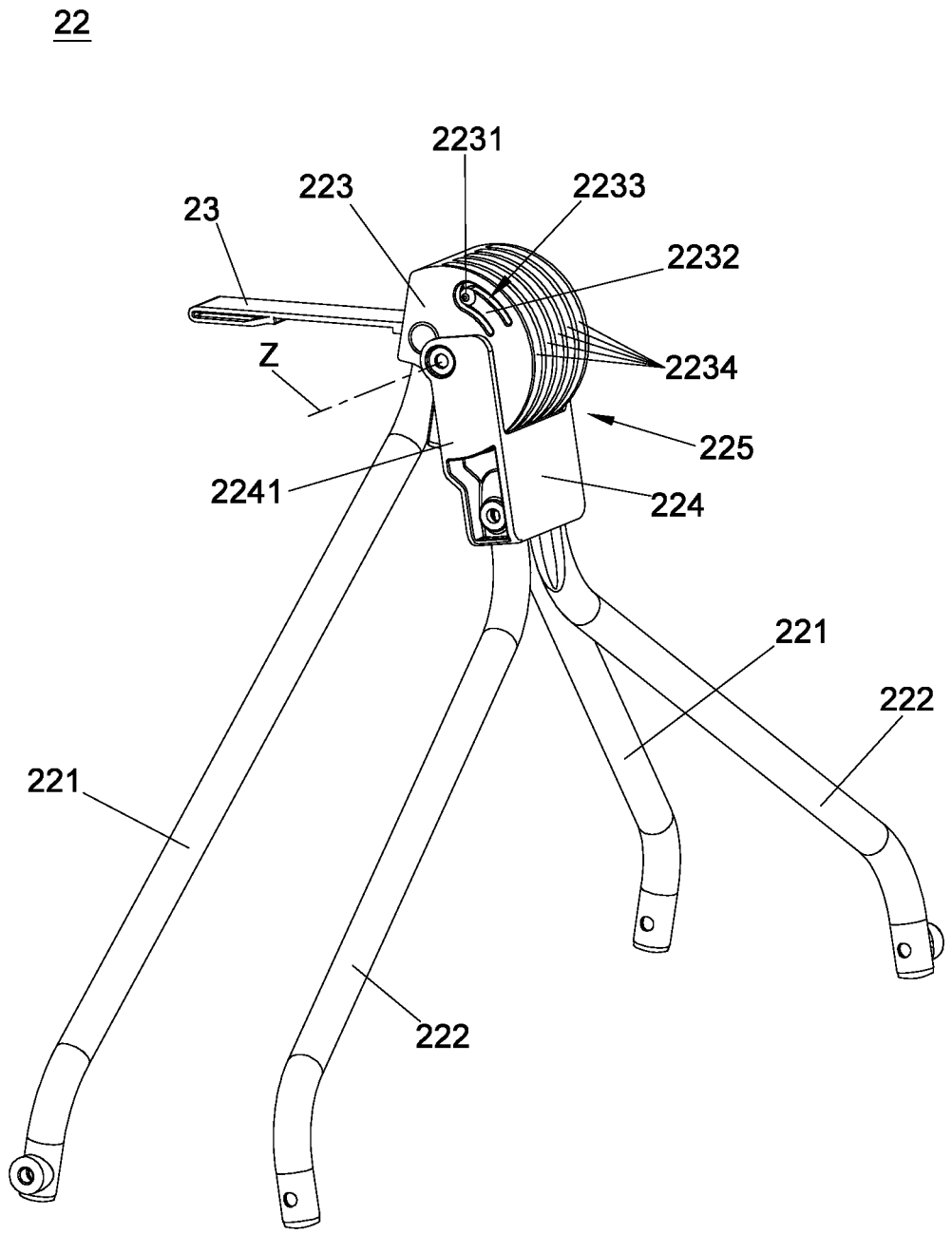
FIG. 17 is a perspective view illustrating the support frame portion in a folded state.
Figure 18:
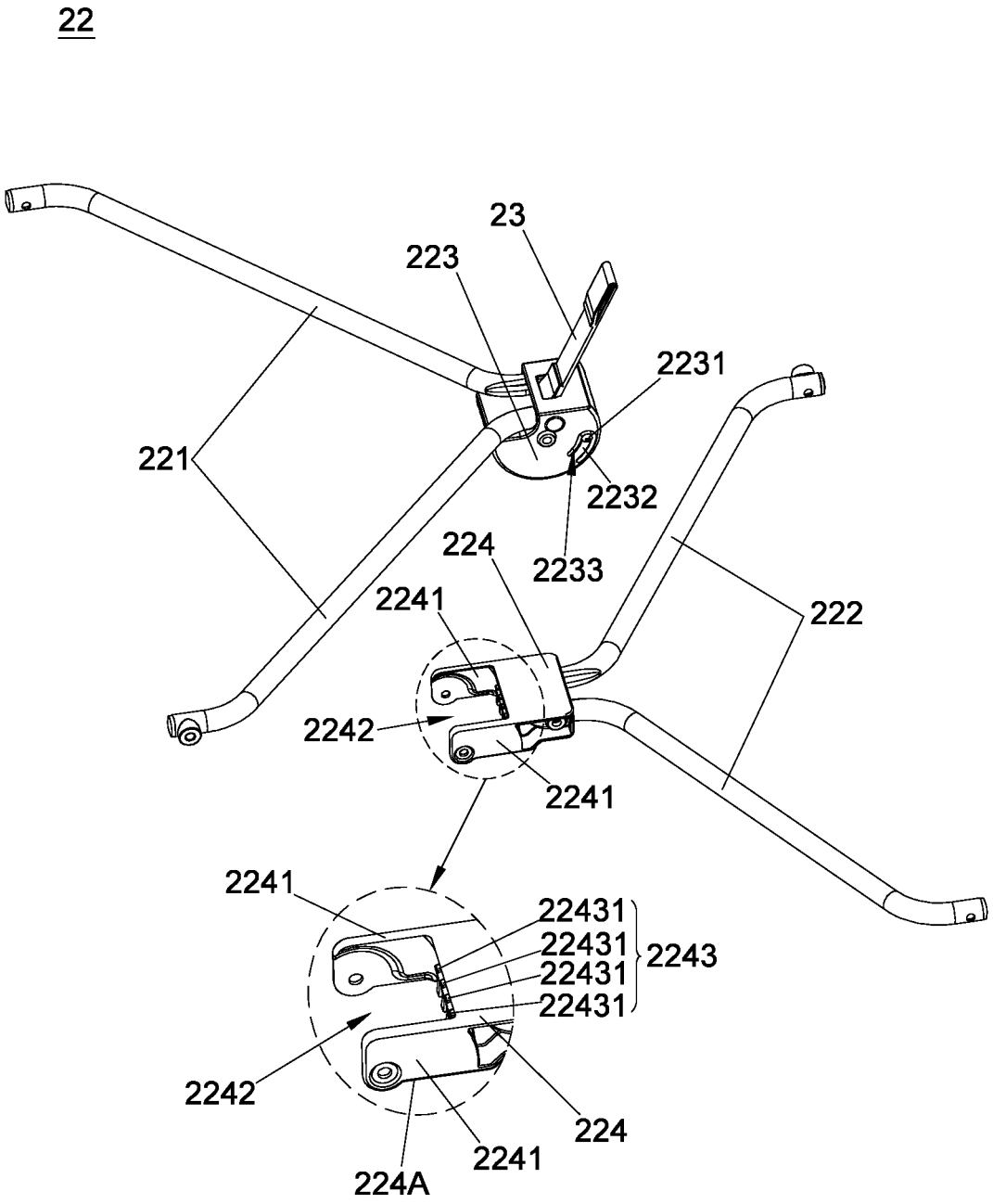
FIG. 18 is an exploded view illustrating some construction details of a central hinge of the support frame portion.
Figure 19:
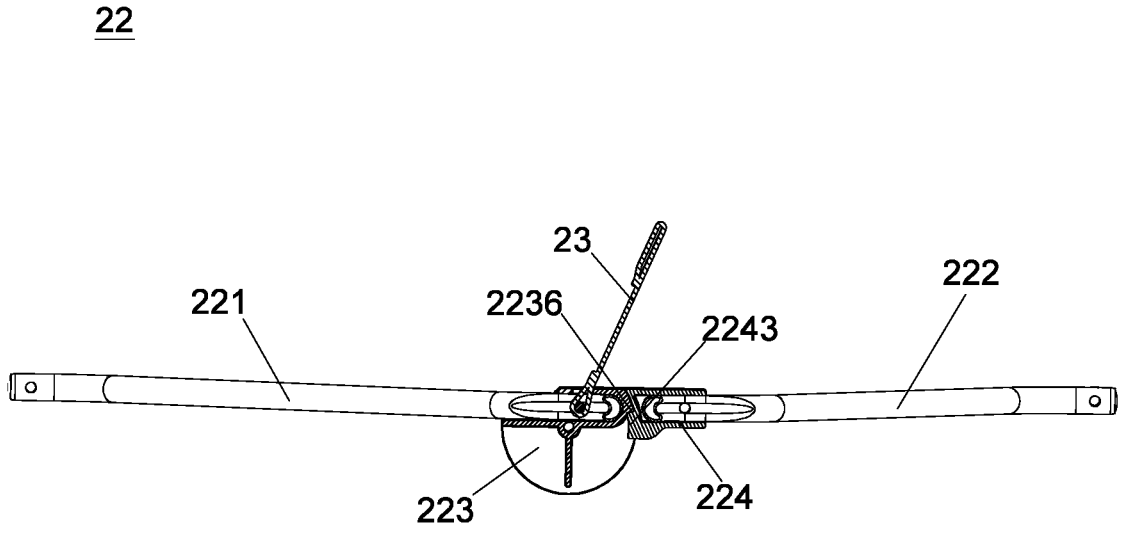
FIG. 19 is a partial cross-sectional view taken along section line A-A shown in FIG. 15.
Figure 20:
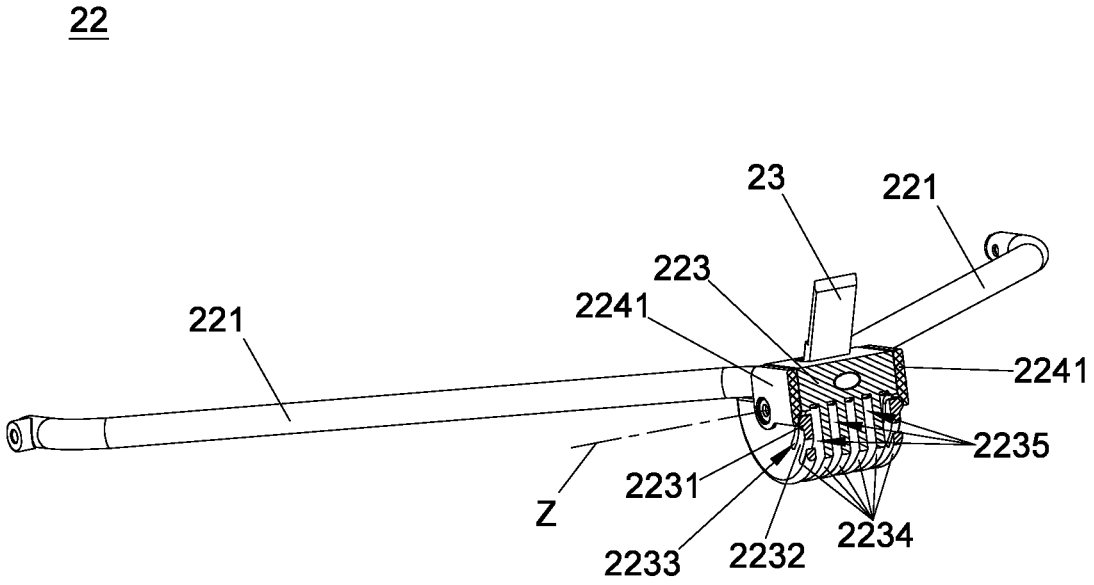
FIG. 20 is a partial cross-sectional view taken along section line B-B shown in FIG. 16.
Figure 21:
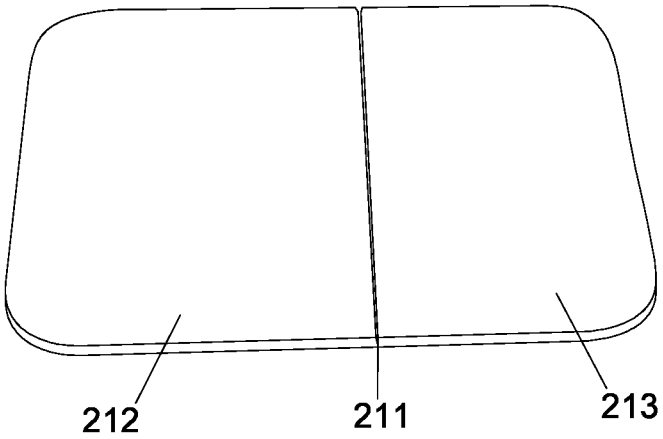
FIG. 21 is a perspective view illustrating a support pad provided in the child bassinet.
Figure 22:
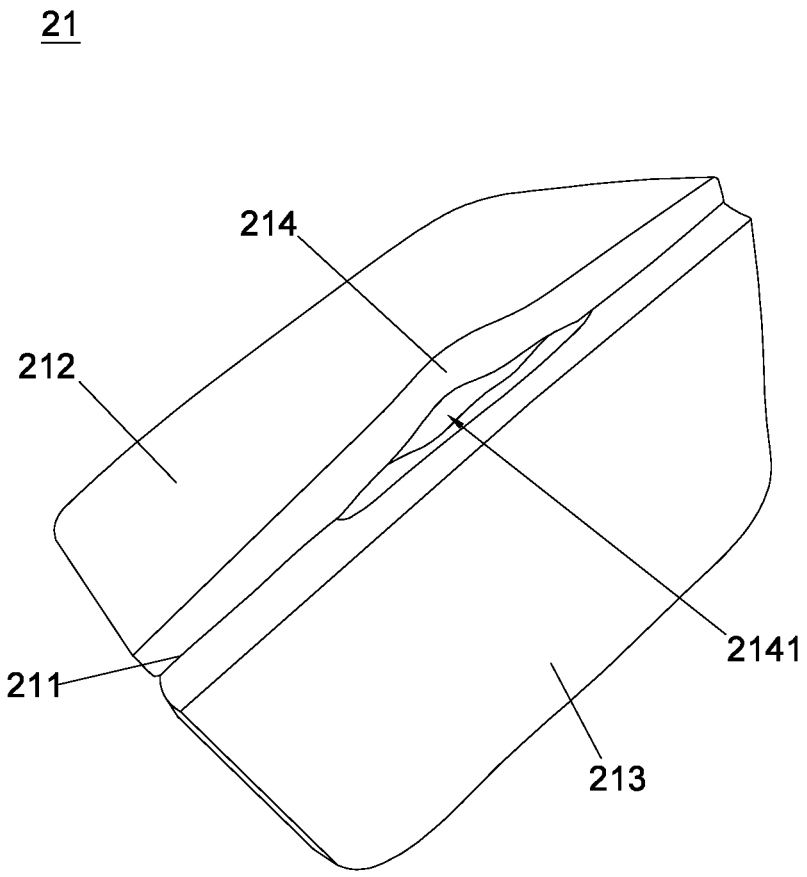
FIG. 22 is a schematic view illustrating the support pad folded about a hinge to reveal a tunnel structure provided in the support pad.
Figure 23:
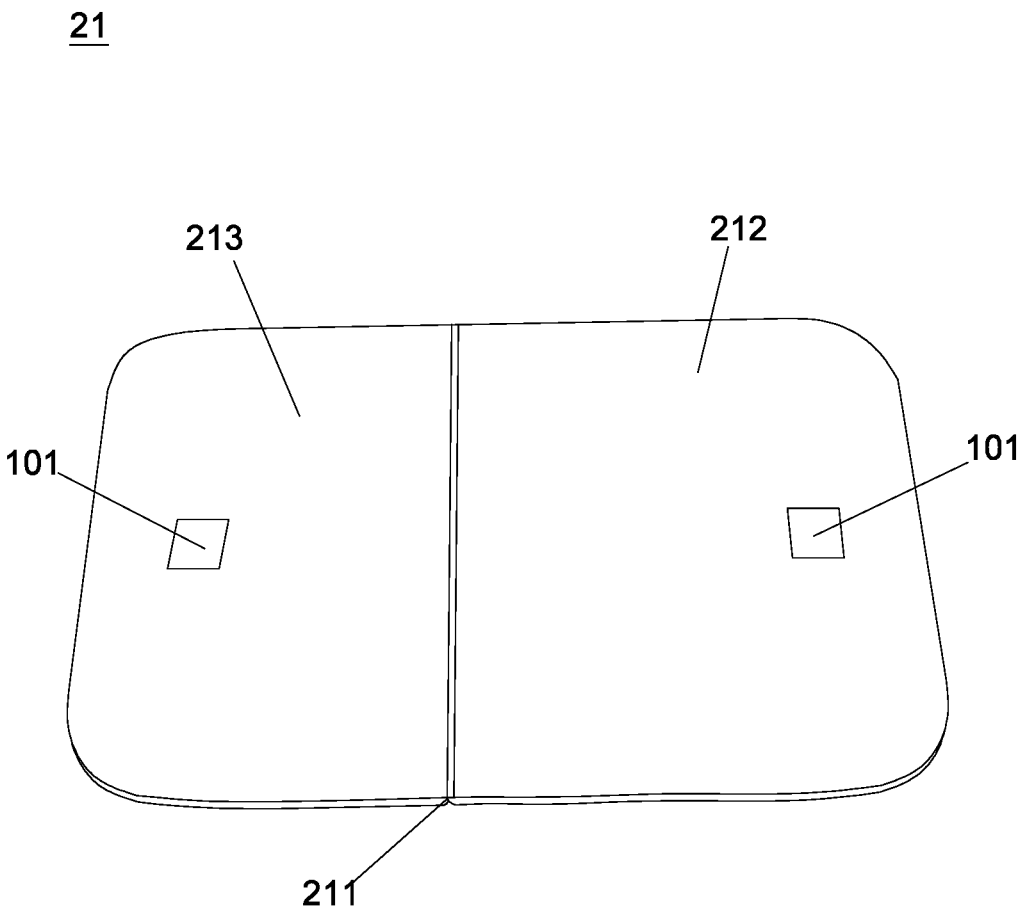
FIG. 23 is perspective view illustrating a bottom of the support pad.

Exemplary operation of the child bassinet 100 is described hereinafter with reference to FIGS. 1-23. Suppose that the child bassinet 100 is initially in the unfolded state. For folding the child bassinet 100, a caregiver can operate to unlock the central hinge 225. For example, the latch 2231 can be urged to disengage from the coupling part 224 to unlock the central hinge 225. Then the caregiver can grasp and raise the operating part 23, which lifts the central hinge 225 and causes the support frame portion 22 to fold. As a result, the two legs 111 and 112 of the standing frame 11 and the two rails 121 and 122 of the top rail portion 12 move concurrently along with the support frame portion 22 to fold in the direction of the arrows shown in FIGS. 11 and 12. The support pad 21 and the storage compartment 30 can also fold along with the frame structure 10, as illustrated in FIG. 6. Once the child bassinet 100 is fully folded, the leg 111 can be substantially parallel to the leg 112, the rail 121 can be substantially parallel to the rail 122 with the articulations 123 positioned atop thereof, and the bar segments 221 can be substantially parallel to the bar segments 222 with the central hinge 225 positioned atop thereof. The folded state is illustrated in FIGS. 13 and 14.

For unfolding the child bassinet 100, the rails 121 and 122 can be rotated relative to the articulations 123 in the unfolding direction, which drives the legs 111 and 112 of the standing frame 11 and the bar segments 221 and 222 of the support frame portion 22 to move concurrently and unfold. The support pad 21 and the storage compartment 30 also unfold along with the frame structure 10. When the child bassinet 100 reaches the unfolded state, the stop structure 2236 of the coupling part 223 can contact against the stop structure 2243 of the coupling part 224 to prevent further rotation in the unfolding direction. Once the child bassinet 100 is fully unfolded, the latch 2231 can engage with the coupling part 224 to lock the central hinge 225 and prevent rotation in the folding direction. The child bassinet 100 can be thereby securely locked in the unfolded state for use.

Advantages of the child bassinet described herein include the ability to provide a frame structure that is relatively simple in construction and can provide stable support for a child. Moreover, the child bassinet can be conveniently folded to a compact form for facilitating transport and storage.

Realization of the child bassinet has been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child bassinet comprising:

a standing frame including a first leg and a second leg, the first leg having two first side segments, the second leg having two second side segments;

a top rail portion connected with the standing frame, the top rail portion including a first rail respectively connected pivotally with the two first side segments and a second rail respectively connected pivotally with the two second side segments, the first rail and the second rail being connected with each other via two articulations, two top ends of the two first side segments being pivotally connected with the first rail at two first locations spaced apart from the two articulations, and two top ends of the two second side segments being pivotally connected with the second rail at two second locations spaced apart from the two articulations; and a support frame portion connected with the standing frame, the support frame portion including two first bar segments that are respectively connected pivotally with the two first side segments and are fixedly connected with a first coupling part, and two second bar segments that are respectively connected pivotally with the two second side segments and are fixedly connected with a second coupling part, the first and second coupling parts being pivotally connected with each other about a pivot axis for forming a central hinge of the support frame portion.

2. The child bassinet according to claim 1, wherein the support frame portion is adapted to receive the installation of a support pad to provide resting support for a child.

3. The child bassinet according to claim 2, wherein a vertical distance between the top rail portion and the support frame portion is smaller than a vertical distance between a lowermost end of the standing frame and the support frame portion when the child bassinet stands in an unfolded state for use.

4. The child bassinet according to claim 1, wherein the second coupling part includes a cavity formed between two sidewalls of the second coupling part, and the first coupling part is placed in the cavity and is pivotally connected with the two sidewalls.

5. The child bassinet according to claim 4, wherein a portion of the first coupling part disposed in the cavity of the second coupling part includes a plurality of fins distributed parallel to one another along the pivot axis of the central hinge.

6. The child bassinet according to claim 5, wherein the first coupling part and the second coupling part respectively have a first stop structure and a second stop structure adapted to engage with each other for stopping the support frame portion in an unfolded state, the second stop structure including a plurality of protruding teeth that are spaced apart from one another along the pivot axis of the central hinge.

7. The child bassinet according to claim 6, wherein the protruding teeth are adapted to travel through a plurality of inter-fin gaps defined between the fins when the first and second coupling parts rotate relative to each other.

8. The child bassinet according to claim 1, wherein the central hinge includes a locking mechanism operable to prevent folding of the support frame portion when the child bassinet is in the unfolded state, the locking mechanism including a latch carried with the first coupling part that is movable to engage with and disengage from the second coupling part.

9. The child bassinet according to claim 8, wherein the latch includes a resilient arm that is connected with the first coupling part and has a free end provided with a protrusion adapted to engage with and disengage from the second coupling part.

10. The child bassinet according to claim 9, wherein the resilient arm has a curved shape extending along an arc approximately centered on the pivot axis of the central hinge.

11. The child bassinet according to claim 1, further including an operating part operable to raise the central hinge for folding the child bassinet.

12. The child bassinet according to claim 11, wherein the operating part is connected with the first coupling part.

13. The child bassinet according to claim 11, wherein the operating part is connected with any of the first and second bar segments adjacent to the central hinge.

14. The child bassinet according to claim 11, further including a support pad detachably installed on the support frame portion to provide resting support for a child, the support pad having a tunnel for passage of the operating part.

15. The child bassinet according to claim 14, wherein the support pad includes a hinge for facilitating folding of the support pad, and the tunnel has an opening adjacent to the hinge, whereby the operating part is accessible for operation through the opening.

16. The child bassinet according to claim 15, wherein the hinge is disposed at an off-center location on the support pad.

17. The child bassinet according to claim 1, further including a storage compartment disposed below the support frame portion.

18. The child bassinet according to claim 1, wherein the first rail and the second rail are respectively connected pivotally with each of the two articulations about two spaced-apart pivot axes.

19. The child bassinet according to claim 1, further including a first linking part connected pivotally with one of the two articulations and one of the two first side segments, and a second linking part connected pivotally with the one of the two articulations and one of the two second side segments.

* * * * *